United States Patent [19]

Lisitsa et al.

[11] 4,308,745

[45] Jan. 5, 1982

[54] HYDRAULIC PRESS

[76] Inventors: Evgeny I. Lisitsa, prospekt Lenina, 170 "g", kv. 3; Alexandr M. Gursky, ulitsa Bocharova, 8, kv. 36; Vitaly G. Kuimov, ulitsa Shkolnaya, 25, kv. 44; Jury S. Makazan, ulitsa 40 let Sovetskoi Ukrainy, 68/5, kv. 14; Alexandr V. Paulsky, ulitsa Shkolnaya, 25, kv. 54; Fedor A. Reznichenko, Dnepropetrovskoe shosse, 46, kv. 10, all of, Zaporozhie; Alexandr V. Romanov, Kombainy pereulok, 11, kv. 27, Kherson; Efim L. Uzorovsky, ulitsa Lezhenko, 7, kv. 12, Zaporozhie, all of U.S.S.R.

[21] Appl. No.: 149,425

[22] Filed: May 13, 1980

[51] Int. Cl.[3] ..... B21J 9/12

[52] U.S. Cl. ..... 72/453.18; 72/343; 72/455

[58] Field of Search ..... 72/453.01, 453.18, 455, 72/343, 344, 345, 407

[56] References Cited

U.S. PATENT DOCUMENTS

| | | | |
|---|---|---|---|
| 2,932,889 | 4/1960 | Kritscher | 72/343 |
| 3,678,728 | 7/1972 | Efimov | 72/455 |

FOREIGN PATENT DOCUMENTS

| | | | |
|---|---|---|---|
| 530854 | 9/1956 | Canada | 72/407 |
| 913437 | 9/1946 | France | 72/343 |

*Primary Examiner*—Gene P. Crosby

*Attorney, Agent, or Firm*—Fleit & Jacobson

[57] ABSTRACT

A horizontal hydraulic press comprises stationary plates, mounted on a bed and linked with columns upon which two slides can move. The slides are moved by double-acting hydraulic cylinders. In a similar way, between said slides there is installed an intermediate slide driven by its own double-acting cylinder. The piston side of this cylinder is connected to a pressure pipeline through a hydraulic distributor and to a return drain pipeline through said hydraulic distributor and a pressure regulator connected in series, while the rod side is connected directly to the pressure pipeline. The rod side of the hydraulic cylinder of one of the two slides is communicated with the pressure pipeline, and the piston side to the pressure pipeline and to the return pipeline through individual hydraulic distributors. Both the rod side and the piston side of the other slide are connected both to the pressure pipeline main and the return pipeline.

2 Claims, 4 Drawing Figures

HYDRAULIC PRESS

BACKGROUND OF THE INVENTION

1. Field of the Invention

The present invention relates to shaping of metal by pressure and more particularly to horizontal hydraulic presses for manufacturing volumetric articles by way of cold deformation.

Most advantageously the invention can be employed in machine-building for manufacturing articles of a complicated configuration, for instance, hollow with variable diameter shafts, or sleeves with enlarged end portions.

2. Prior Art

Known in the art is a horizontal hydraulic press (cf. catalogue of Bliss Pera, USA), comprising a bed, a table, an outer slide, and an inner slide. The inner slide is connected to the rod of a hydraulic cylinder and moved along the guides fixed on the outer slide. The movement of the outer slide in relation to the inner slide is provided by double-acting cylinders mounted on the inner slide brackets extending through the slots made in the outer slide. The deformation force is produced by single-acting cylinders built in the inner slide. Both slides can operate simultaneously or independently.

Such construction and the hydraulic control system of the above press do not allow the manufacture of articles the production of which requires an alternate movement of the slides and the table during the shaping process, and that the movable parts of the press become alternately immovable for a certain period of time. In the course of the deformation process, rupture may occur when producing such articles as sleeves or pipes with enlarged portions which results from the lack of a controlled "yielding" base exerting a predetermined counterpressure upon the flowing metal. Therefore, technological capabilities of the above process are limited.

The above disadvantage restricts the possibility of producing articles with two or three deformation transitions from a work piece once positioned which limits the use of the described process.

SUMMARY OF THE INVENTION

An object of the invention is to provide a hydraulic press for manufacturing volumetric articles of a complicated configuration by way of cold deformation, whose technological capabilities are more varied as compared to the prior art level.

More specifically an object of the invention consists in providing a hydraulic press which, along with ordinary volumetric articles, can produce articles of a complicated configuration from a work piece once installed, for instance tubular parts with enlarged ends thereof, i.e. disk forging blanks for telescopic hoists.

Another object of the invention consists in providing a hydraulic press, wherein the deformation force is counteracted by counterpressure, thereby producing articles according to a predetermined scheme of the work piece deformation.

These and other objects of the invention are accomplished in that a hydraulic press comprising stationary plates mounted on a bed and connected with each other by guiding columns, also two slides mounted for movement between the stationary plates and driven by double-acting cylinders connected with a pressure pipeline and a return pipeline through hydraulic distributors, according to the invention, has an intermediate slide located in between said two slides, and a double-acting hydraulic cylinders for actuating said intermediate slide, the piston side of said hydraulic cylinder being connected to the pressure line through a hydraulic distributor, and, through the same hydraulic distributor and a pressure regulator seriesly connected, to the return pipeline, while the rod side being connected directly to the pressure pipeline the rod side of the hydraulic cylinder of one of the above two slides is connected to the pressure pipeline and the piston side, through individual hydraulic distributors, to the pressure pipeline main and the return pipeline.

Using such embodiment of the hydraulic press and the hydraulic control system thereof permits each of the slides to be moved independently, and allows, if need be, the deformation force to be counteracted by the counterpressure of the intermediate slides. This makes it possible to produce, from a work piece once positioned, both ordinary articles and those of a complicated configuration which, according to the existing deformation schemes, can only be obtained after second or third positioning. As a result, the press technological capabilities become more varied and the efficiency increased.

It is expedient that between the hydraulic distributor and the piston cavity of each of the cylinders be installed a controlled return valve.

Depending on the configuration of the article produced and the manufacturing process involved, a corresponding slide can be locked by hydraulic seal.

BRIEF DESCRIPTION OF THE DRAWINGS

They hydraulic press will now be described in detail with reference to the accompanying drawings wherein the same parts are given the same reference numerals, and in which.

DETAILED DESCRIPTION OF THE PREFERRED EMBODIMENT OF THE INVENTION

Figure 1:
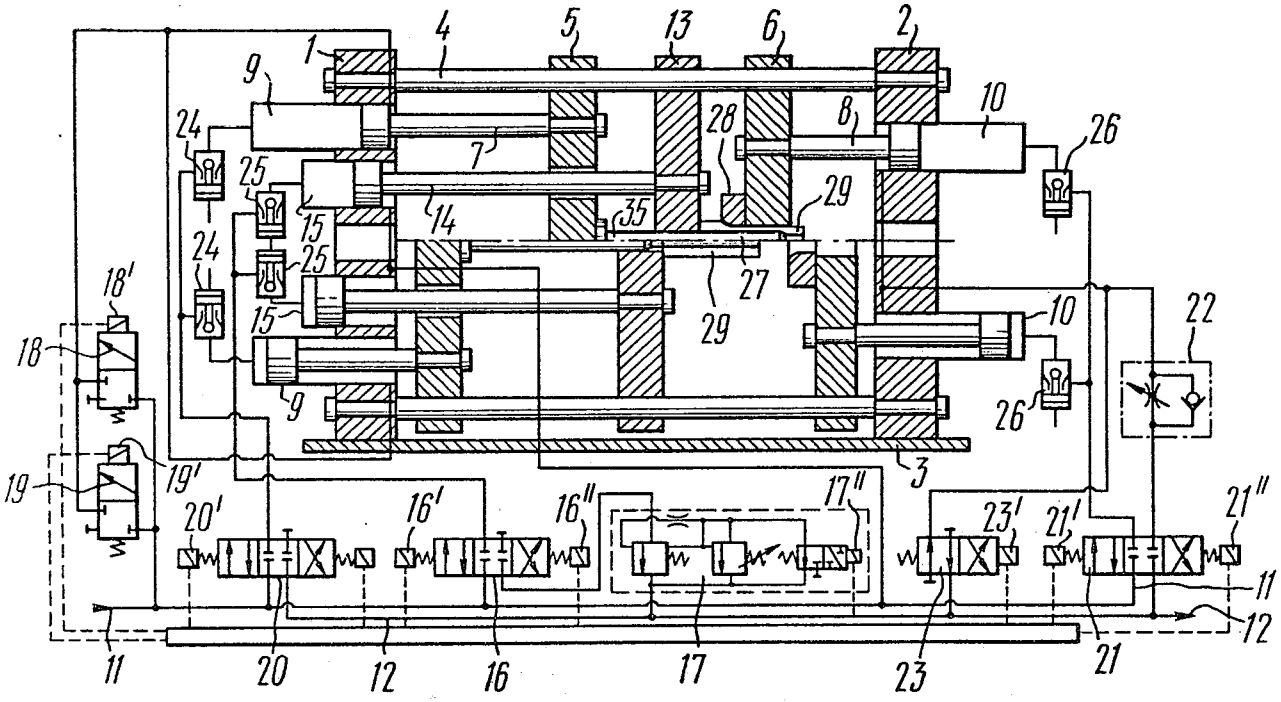
FIG. 1 is a schematic view of a hydraulic press with a hydraulic control system according to the invention, showing the initial and working positions thereof (the lower and the upper parts relative to the press axis respectively)

A hydraulic press comprises stationary plates 1 and 2, both mounted on a bed 3 and connected with each other by guiding columns 4. Two slides 5 and 6 are installed for movement between the stationary plates 1 and 2, and driven by rods 7,8 of hydraulic cylinders 9,10 respectively, connected to the hydraulic control system of the press. The hydraulic system comprises a pressure pineline 11 and a return pipeline 12, both connected to the hydraulic cylinders 9 and 10 through respective hydraulic distributors (to be described below).

According to the invention, an intermediate slide 13, linked to a rod 14 of double-acting hydraulic cylinder 15, is mounted in between the slides 5 and 6. The piston side of the hydraulic cylinder 15 is connected with the pressure pipeline 11 through a hydraulic distributor 16, and with the return pipeline 12 through said hydraulic distributor 16 and a pressure regulator 17 connected in series. The rod side of the hydraulic cylinder 15 is connected directly with the pressure pipeline 11. The sides of the hydraulic cylinder 9 of the slide 5 are connected to the pressure pipeline 11 through paralelly connected hydraulic distributors 18 and 19, while the piston sides to the pressure pipeline 11 and the return pipeline 12 through a hydraulic distributor 20.

Mounted between the hydraulic distributors 20, 21, 16 and the piston side of each of the hydraulic cylinders 9, 10 and 15 are controlled return valves 24, 25 and 26 respectively. The hydraulic cylinder 10 is communicated with the pressure pipeline 11 and the return pipeline 12 through the hydraulic distributor 21, the rod side of said cylinder being connected with the hydraulic distributor 21 through a throttle 22, and with the return pipeline 12 through a hydraulic distributor 23.

Each hydraulic distributor is provided with one or two electromagnets for control, designated in drawings with the same reference numerals as respective distributors, and marked with one or two hachures.

Mounted on the slide 5; along the axis of the press is a mandrel 27 a hole is made in the slide 13, and a female die 28 is installed on the slide 6.

The operation of the described press is as follows.

Figure 2:
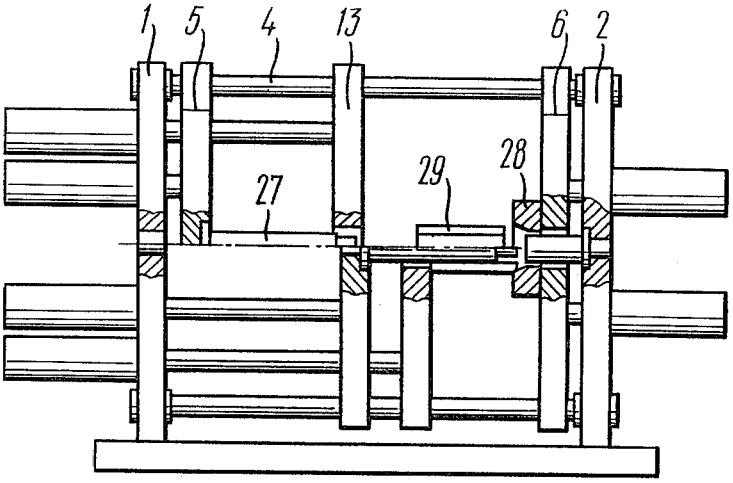
FIGS. 2,3,4 show relative positions of the press movable parts during the deformation of the work piece.
Figure 3:
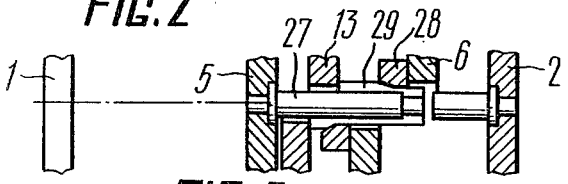
Figure 4:
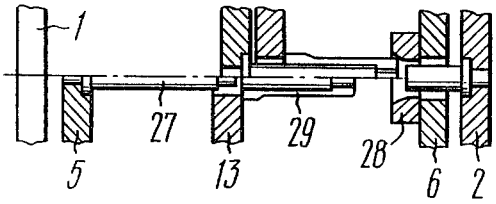

Position when the pistons touch the bottom of the cylinders is considered to be the initial position of the press (FIG. 1—lower part; FIG. 2—upper part).

A work piece in the form of a pipe 29 is fed to the press and positioned between the slide 13 and the female die 28. By switching on the electromagnets 18', 19' and 20' of the hydraulic distributors 18, 19 and 20, both cavities of the hydraulic cylinders 9 are connected to the pressure pipeline 11.

The slide 5 is moved with increasing speed forward until the mandrel 27 enters the work piece 29; after this the electromagnet 18' is switched off and the slide 5 continues moving at an operating speed, thereby effecting preliminary preparation of the inner surface of the work piece 29, whereafter the electromagnets 19' and 20' are switched off, and the slide 5 is locked by hydraulic seal. Then, by switching in the electromagnet 16' of the hydraulic distributor 16, the piston cavities of the hydraulic cylinders 15 are connected to the pressure pipeline 11, the slide 13 moves on until it rests against the butt end of the work piece 29 and is also locked by hydraulic seal.

The squeezing of the work piece 29 on the mandrel 27, as well as reducing thereof is effected by moving the slide 6, for which purpose the electromagnets 23' and 21' of the hydraulic distributors 23 and 21 are switched in. Before the squeezing of the work piece 29 on the mandrel 27 is completed, the electromagnet 23' is switched off and the transitional section of the article is formed at a slower speed of the slide 6.

After the enlarged portion is on the end of the work piece 29, the latter is firmly held upon the mandrel 27. Therefore, by switching in the electromagnets 16'' and 17'', the slide 13 is released from the hydraulic seal and, exerting a predetermined counterpressure (according to pressure regulator 17 presetting), is moved towards the initial position under the action of the flowing metal.

Simultaneously, after switching in the electromagnet 23, the slide 6 begins moving with increasing speed once again. Once the outer surfaces of the work piece are formed, the electromagnets 23' and 17'' are switched off, and the electromagnet 21'' of the hydraulic distributor 21 is switched on instead of the electromagnet 21'. The slides 13 and 6 return to their initial positions, after which, as a result of switching in the electromagnets 16'' and 18', the slide 5 also returns to its initial position. The butt end of the work piece 29 rests against the immovable slide 13, while the mandrel 27, moved by the slide 5, effects finishing of the inner surface of the work piece 29. The finished article 29 fall upon a receiving tray (not shown). The working cycle is over.

It is quite clear that by changing the sequence and speed of movement of the slides, other metal deformation schemes can be carried out, in compliance with the technology of producing articles of a predetermined form.

We claim:

1. In a hydraulic press having a bed, stationary plates mounted on said bed, guiding columns linking said stationary plates, a pair of slides mounted for movement between said stationary plates, double-acting hydraulic cylinders for driving each of said slides of said pair of slides, said cylinders having a piston side and a rod side both connected with a pressure pipeline and a return pipeline through hydraulic distributors, an improvement comprising an intermediate slide located between said slides, a double-acting hydraulic cylinder for driving the above intermediate slide, said cylinder having a piston side connected to said pressure pipeline and return pipeline, and a rod side connected directly to said pressure pipeline, a hydraulic distributor installed between the piston side of the above double-acting hydraulic cylinder of said intermediate slide and the pressure pipeline, a pressure regulator, installed between said hydraulic distributor and return pipeline, the rod side of said hydraulic cylinder of one of said slides is connected to said pressure pipeline, and the piston side to said pressure pipeline and return pipeline through an individual hydraulic distributor of said hydraulic distributors.

2. The invention according to claim 1, wherein between a corresponding hydraulic distributor and the piston side of each of the hydraulic cylinders is installed a controlled return valve.

* * * * *